United States Patent [19]

Kito et al.

[11] 4,283,722

[45] Aug. 11, 1981

[54] OVERLOAD INDICATION DEVICE FOR A LEVER HOIST

[75] Inventors: Miyoshi Kito, Tokyo; Kazuo Igarashi, Kawasaki, both of Japan

[73] Assignee: Kabushiki Kaisha Kito, Kawasaki, Japan

[21] Appl. No.: 959,273

[22] Filed: Nov. 9, 1978

[30] Foreign Application Priority Data

Nov. 11, 1977 [JP] Japan ..... 52-134702
Nov. 12, 1977 [JP] Japan ..... 52-135974

[51] Int. Cl.[3] ..... B66C 3/00; G08B 21/00

[52] U.S. Cl. ..... 340/685; 74/523; 116/68; 116/143; 200/61.58 R; 200/85 R; 254/369; 340/666

[58] Field of Search ..... 340/665, 666, 685; 200/61.58 R, 85 R, DIG. 26, 67 AA; 116/68, 212, 282, 143, DIG. 1, DIG. 4; 74/523; 254/173 B, 174; 212/39 MS; 73/141 A, 760, 781

[56] References Cited

U.S. PATENT DOCUMENTS

| | | | |
|---|---|---|---|
| 1,175,850 | 3/1916 | Welker | 116/143 X |
| 2,988,040 | 6/1961 | Aitken | 212/39 MS X |
| 3,072,264 | 1/1963 | Sennebogen | 212/39 MS |
| 3,123,814 | 3/1964 | Aitken | 340/685 |
| 3,148,659 | 9/1964 | Aitken | 212/39 MS X |
| 3,834,550 | 9/1974 | Eiler | 340/685 X |
| 3,876,182 | 4/1975 | Hansson | 254/174 X |
| 4,112,750 | 9/1978 | Murakami | 340/685 X |

*Primary Examiner*—Donald J. Yusko
*Assistant Examiner*—Joseph E. Nowicki
*Attorney, Agent, or Firm*—Sughrue, Rothwell, Mion, Zinn and Macpeak

[57] ABSTRACT

An overload indication device for a lever hoist comprises an operating lever consisting of a main lever and a handle having one end pivoted to the main lever, a spring for normally holding the handle in an aligned position with the main lever, a magnification lever for deforming the spring by the rocking movement of the handle by a force corresponding to an overloading and a warning device for warning of the overloading, such as a buzzer, whistle or colored indicator adapted to be operated when the handle rocks to assume an angular position relative to the main lever.

7 Claims, 11 Drawing Figures

A
B
1
2
3
4
5
6
13
15
16
17
18
19
21
22
23

OVERLOAD INDICATION DEVICE FOR A LEVER HOIST

BACKGROUND OF THE INVENTION

1. Field of the Invention:

The present invention relates to an overload indication device for a lever hoist to prevent it from being operated under an overload condition.

It will be understood that the expression "lever hoist" used herein will means a manually operated hoist having a lever which is repeatedly rocked by a hand of an operator to rotatively drive a load sheave around which extends a chain or wire rope having at one end a loading hook.

2. Description of the Prior Art:

Various devices for preventing overloading of lever hoists have been suggested. There has been used a lever hoist including a main lever provided with a change-over ratchet for driving a change-over ratchet wheel and a handle pivotally secured to a free end of the main lever, between which handle and main lever a shear pin is provided adapted to be sheared when being subjected to an overload. With this hoist however, there is a risk in operation due to a rapid rotation of the handle relative to the main lever when the shear pin is sheared owing to the overload. The sheared pin must be replaced by a new one, which requires troublesome and time consuming operation. As the sheared pin can not be used again, it may increase the maintenance costs. Moreover, it is difficult to produce shear pins having uniform shearing strengths which would be determined by severe tolerance and uniform quality of material. Dimensional error and difference in quality of material cause differences in the shearing strength of the shear pins which would not achieve an overload prevention with a high accuracy.

Another lever hoist has been proposed which includes a main lever and a handle of which one corner of one end is pivoted to one corner of a free end of the main lever, and a pellet accommodated in engaging apertures formed in the other corners of the ends of the main lever and handle and urged by a compression spring. When the hoist is in an overloaded condition, the pellet moves from the engaging apertures against the compressive force of the spring with the aid of camming action of a rounded end of the pellet, as disclosed in Japanese Utility Model Application Publication No. 34,393/73. With this arrangement, there is a tendency for the pellet to be rapidly removed from the engaging apertures resulting in a rapid rotation of the handle relative to the main lever, which is dangerous in operation. Furthermore, the pellet moves from the apertures while frictionally sliding thereon, thereby not achieving an overload prevention with a high accuracy.

A further lever hoist has been suggested including a main lever and a handle of which one corner of one end is pivoted to a free end of the main lever, and a pressure receiving member urged by Belleville springs and in contact with the pivoted end of the handle through a slipper member. In use, the handle is pivotally moved relative to the main lever corresponding to a load acting upon the hoist thereby detecting a loaded condition by the angle of the handle, as disclosed in U.S. Pat. No. 3,921,471. With this arrangement, the overloading is determined by an operator by an observation of the angle of the handle, so that an exact determination of overloading is very difficult. Moreover, after the handle has been once pivotally moved relative to the main lever, if the handle is released, the handle is returned by the action of the Belleville springs to an original position aligned with the main lever, so that the determination of the overloading is difficult.

SUMMARY OF THE INVENTION

It is an object of the invention to provide an improved overload indication device for a lever hoist which eliminates the above disadvantages in the prior art.

It is another object of the invention to provide an overload indication device wherein when the operating lever is rocked under an overload condition, the handle is pivotally moved relative to the main lever more than a determined angle thereby operating an overload warning device to clearly indicate the overloading acoustically and/or visually.

It is further object of the invention to provide an overload indication device wherein even if the handle is released, it is kept in the angular position relative to the main lever by a holding spring to achieve a continuous indication of the overloading.

In order that the invention may be more clearly understood, preferred embodiments will now be described, by way of example, with reference to the accompanying drawings.

DETAILED DESCRIPTION OF THE PREFERRED EMBODIMENT

Figure 1:
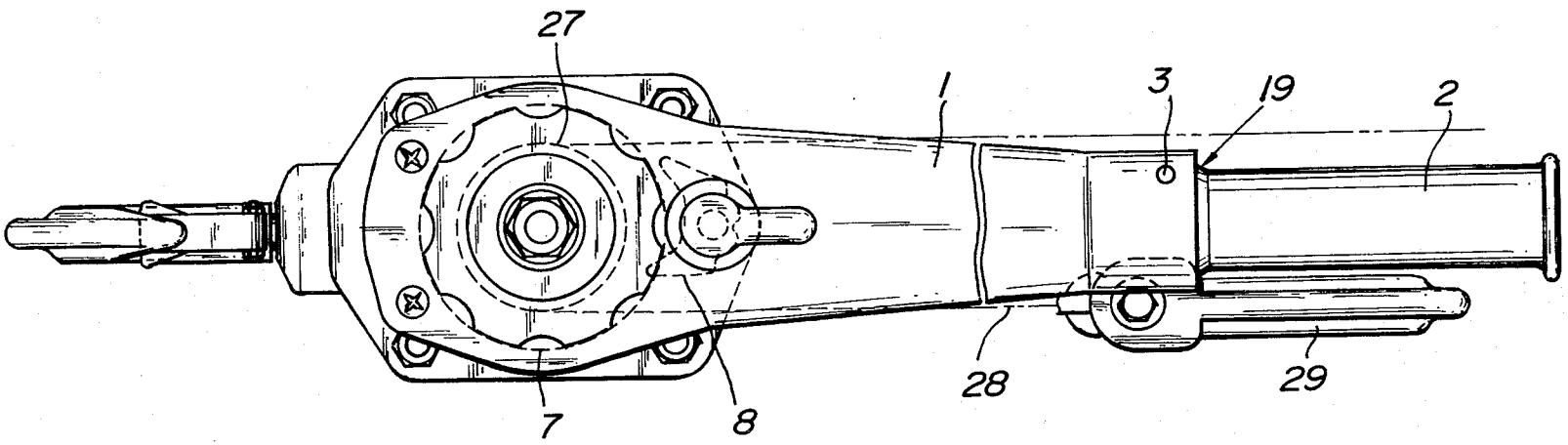
FIG. 1 is a front elevation of a lever hoist employing an overload indication device according to the invention.

Referring to FIGS. 1–4 illustrating a first embodiment of the present invention, wherein a lever chain hoist or lever wire hoist comprises a change-over ratchet wheel 7 and a main lever 1 having a pivotal end rotatably fitted on the ratchet wheel 7 and provided with a change-over ratchet 8 including a pair of jaws adapted to engage the ratchet wheel 7. The main lever 1 and the handle 2 form an operating lever 19 for the lever hoist. Onto a corner of a free end of the main lever 1 is pivotally secured a handle at a corner of one end thereof by means of a connecting pin 3 parallel to a support shaft of the change-over ratchet wheel 7. To the inside of the main lever 1 at the mid portion thereof is fixed an overload warning buzzer 9, a battery holder 11 for detachably housing batteries 10, and a limit switch LS for actuating the buzzer 9.

Figure 2:
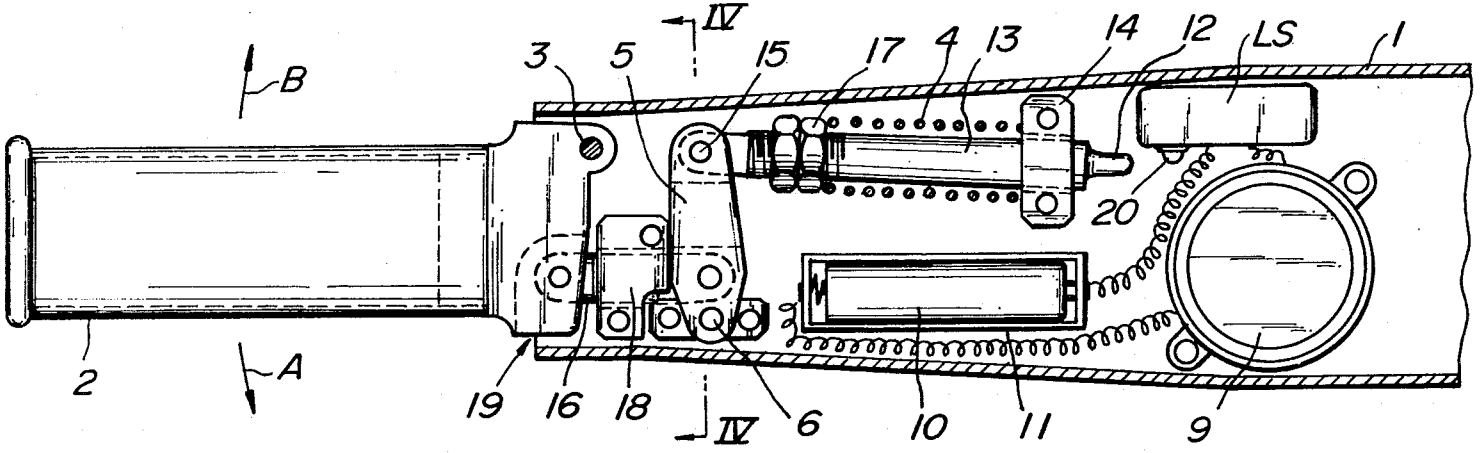
FIG. 2 is a sectional view of a first embodiment of the device according to the invention.
Figure 3:
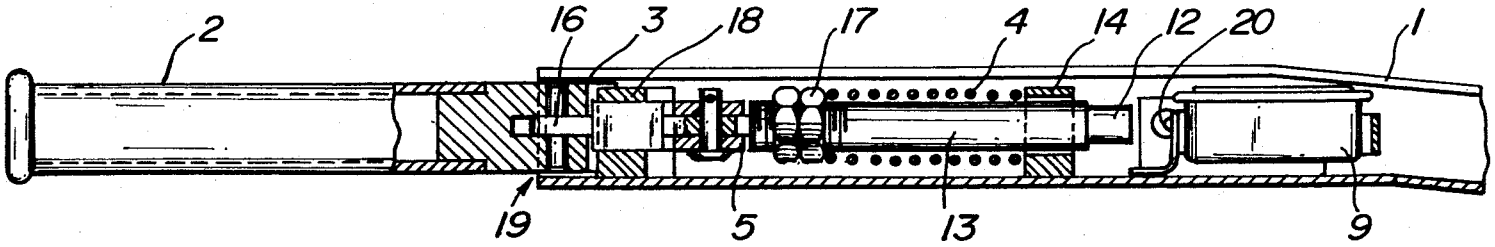
FIG. 3 is a side view of the device shown in FIG. 2.

Referring to FIGS. 2 and 3, a holding rod 13 extending in a longitudinal direction of the main lever 1 is provided at one end near the limit switch LS with a switch actuator 12. The one end of the holding rod 13 is slidably fitted in a support fitting 14 fixed to the main lever 1. The other end of the holding rod 13 is pivotally secured to one end of a force magnification lever 5 extending in a direction perpendicular to the longitudinal direction of the main lever 1 by means of a pin 15. The other end of the force magnification lever 5 is pivoted at 6 to the main lever 1 and connected by a link 16 to the pivoted end of the handle 2 at a corner opposite to the pivoted corner.

A holding coil spring 4 is arranged under compression between the support fitting 14 and adjusting nuts 17 threadedly engaged on the holding rod 13. An initial compressive force of the coil spring 4 can be adjusted by the adjusting nuts 17 depending upon the overload to be detected. As shown in FIGS. 2 and 3, the main lever 1 is fixed to a stopper 18 adapted to engage the lever 5 to stop it at a determined position where the handle 2 is kept straightly aligned with the main lever 1 when the hoist is under no load or slightly loaded condition. A chain or wire rope 28 extends about a load sheave 27 and is provided at its lower end with a loading hook 29.

In use, the hoist is operated by repeatedly rocking the operating lever 19 consisting of the main lever 1 and the handle 2 gripped by a hand in directions of arrows A and B for raising or dragging objects. Assuming that a load exceeds a predetermined value, when the operating lever 19 is rocked by the handle 2 in the direction of the arrow A for raising or dragging the object, the holding coil spring 4 is compressed to an extent proportional to the load and thus the holding rod 13 is moved towards the limit switch LS. A further movement of the operating lever 19 in the direction of the arrow A causes the switch actuator 12 of the holding rod 13 to push a contact operating member 20 to turn the limit switch on resulting in an operation of the overload warning buzzer 9.

With this first embodiment of the invention, the overload warning buzzer 9 is operated when the hoist is about to be operated under an overloaded condition, so that the overloading can easily be acoustically detected in a gloomy room with a high detection accuracy.

As an alternative, the support fitting 14 may be pivotally mounted on the main lever 1 by means of a support pin in parallel with the pivot pin 6 of the force magnification lever 5 and thus the holding rod 13 may be closely slidably fitted in the support fitting 14. An overload warning lamp may be provided in substitution for the buzzer 9.

Figures 4, 5, 6:
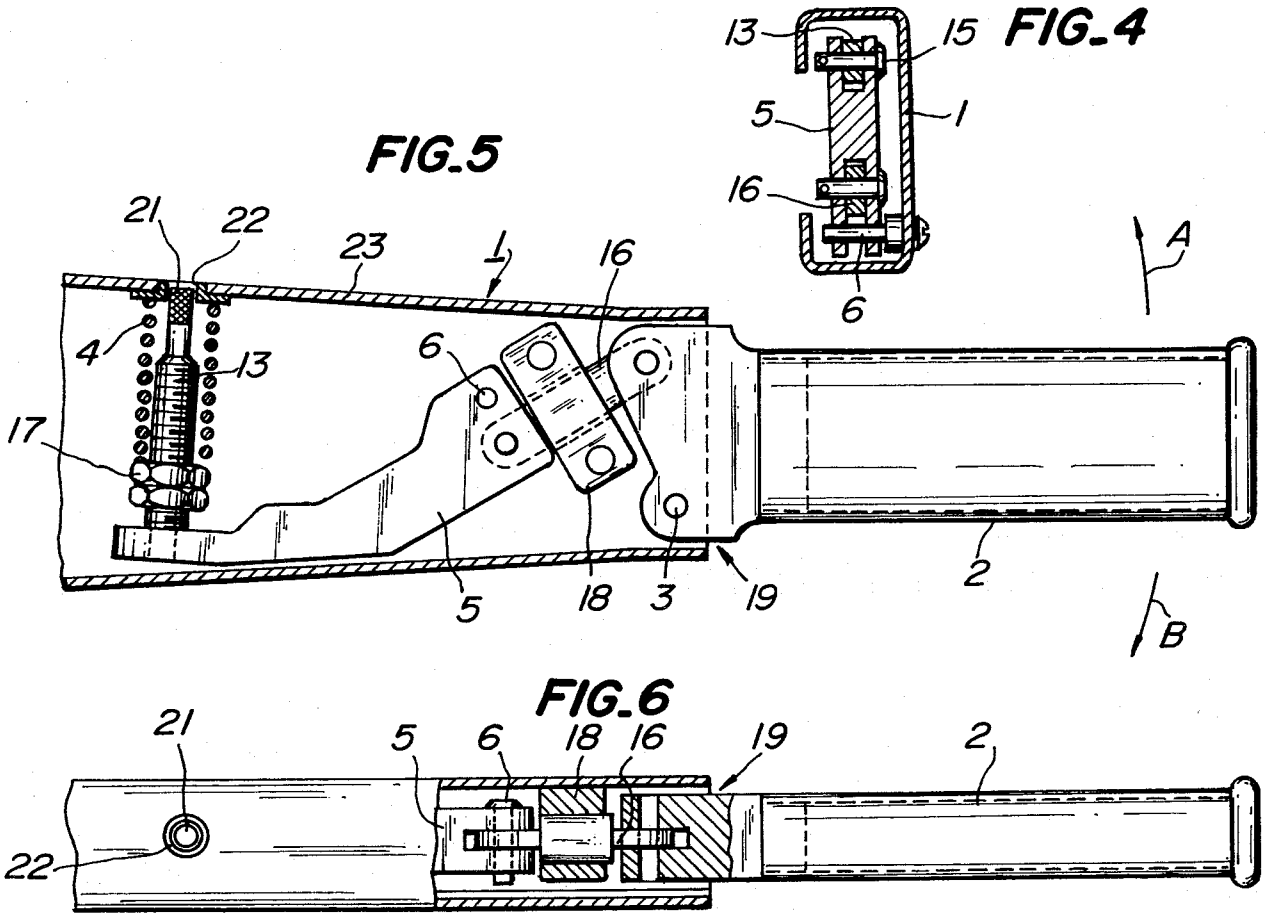
FIG. 4 is a sectional view taken along lines IV—IV of FIG. 2.
FIG. 5 is a sectional view of a second embodiment of the device according to the invention.
FIG. 6 is a side view of the device shown in FIG. 5.

FIGS. 5 and 6 illustrate a second embodiment of the invention, wherein like components have been designated by the same reference numerals in the first embodiment. To a corner of a free end of a main lever 1 is pivotally secured a handle 2 at a corner of its one end by means of a connecting pin 3 parallel to a support shaft of a change-over ratchet wheel 7. The main lever 1 and the handle 2 form an operating lever 19 for the lever hoist as in the first embodiment. A force magnification lever 5 is pivoted at a corner of its one end to the proximity of the free end of the main lever 1 by means of a pivot pin 6 in parallel with the connecting pin 3. The other corner of the one end of the handle 2 and the other corner of the one end of the lever 5 are connected to each other by means of a link 16. On the other end of the lever 5 is provided a holding rod 13 having one end slightly rockably connected to the lever 5 by means of a pin 15 as shown in FIG. 4.

The holding rod 13 is provided on the other end with a colored (for example in red) portion 21 for indicating an overloading. A flanged bushing 22 is fitted in a through hole formed in the side wall 23 of the main lever 1 on the inside thereof and slidably receives the colored portion 21 of the holding rod 13 therein. A holding coil spring 4 is arranged under compression between the flanged bushing 22 and adjusting nuts 17 threadedly engaged on the holding rod 13. To the main lever 1 is fixed a stopper 18 adapted to engage the lever 5 to stop it at a determined position when the hoist is under no load or slightly loaded condition.

In use, the hoist is operated by repeatedly rocking the operating lever 19 consisting of the main lever 1 and the handle 2 gripped by a hand in directions of arrows A and B for raising or dragging objects. In the event that a load exceeds a predetermined value, when the operating lever 19 is rocked by the handle 2 in the direction of the arrow A for raising or dragging the object, the coil spring 4 is compressed to an extent in proportional to the load and thus the holding rod 13 is moved so as to extend the colored portion 21 out of the flanged bushing 22 to indicate the overload.

With this second embodiment, the overload can be indicated by the use of the above simple mechanism without using electrical power. The inner end of the holding lever 13 may be firmly fixed to the force magnification lever 5 and the colored end of the holding lever 13 may be loosely fitted within the flanged bushing with a sufficient clearance.

Figure 7:
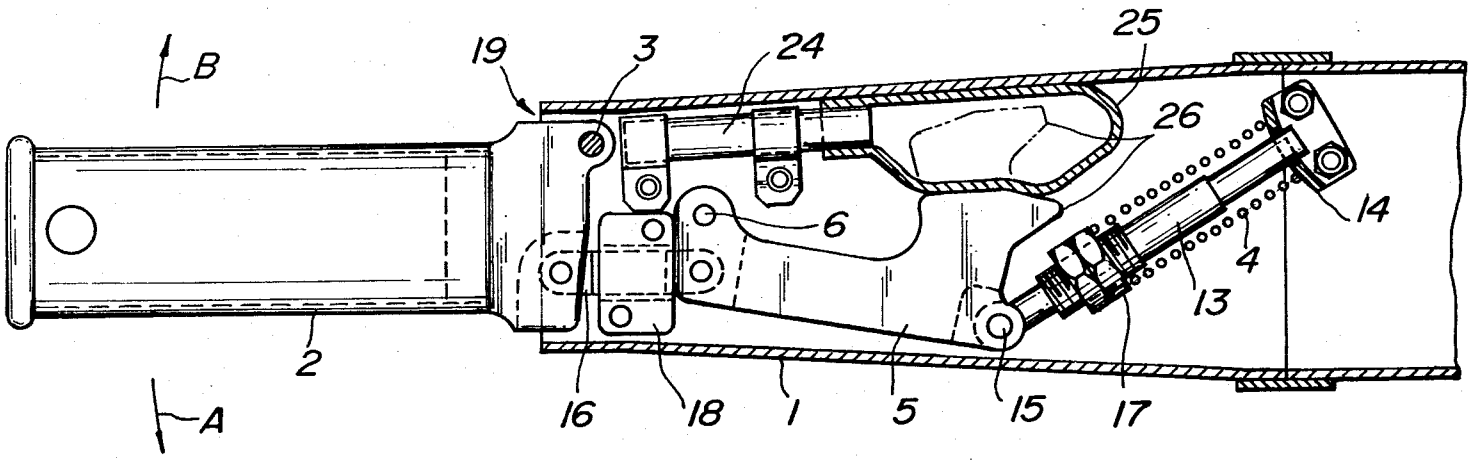
FIG. 7 is a sectional view of a third embodiment of the device according to the invention.
Figure 8:
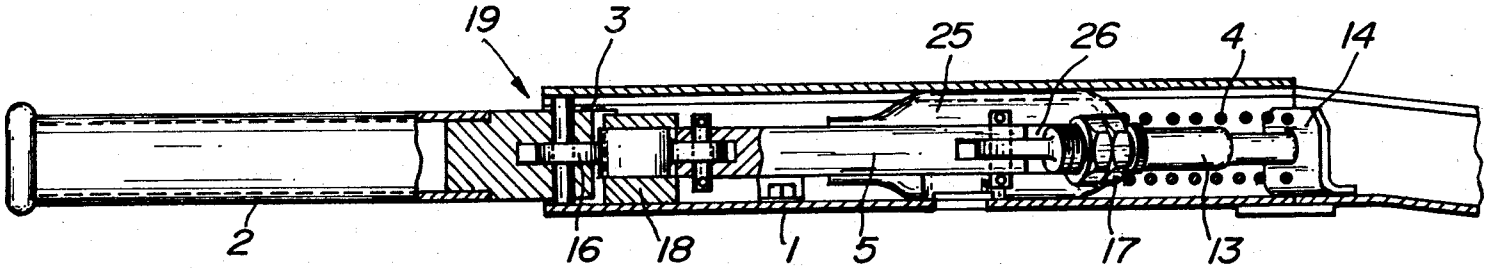
FIG. 8 is a side view of the device shown in FIG. 7.

Referring to FIGS. 7 and 8 illustrating a third embodiment of the invention, wherein like components have been designated by the same reference numerals in the above mentioned embodiments, to a corner of a free end of a main lever 1 is pivotally secured a corner of one end of a handle 2 by means of a connecting pin 3 in parallel with a support shaft of a change-over ratchet wheel. The main lever 1 and the handle 2 form an operating lever 19 for the lever hoist as in the previous embodiments. A force magnification lever 5 is pivoted at a corner of the one end to the proximity of the free end of the main lever 1 by means of a pivot pin 6 parallel to the connecting pin 3. The other corner of the one end of the handle and the other corner of the pivoted end of the force magnification lever 5 are connected to each other by means of a link 16. On the other end of the magnification lever 5 is provided a holding rod 13 having one end pivotally connected to the lever 5 by means of a pin 15 and the other end loosely fitted within a support fitting 14 fixed to the main lever 1.

A holding coil spring 4 is arranged under compression between a convex support surface of the support fitting 14 and adjusting nuts 17 threadedly engaged on the holding rod 13. To the main lever 1 is fixed a stopper 18 adapted to engage the lever 5 to stop it at a determined position when the hoist is under no load or slightly loaded condition. To the main lever 1 are further fixed a flute 24 for warning of an overloading and a bellows 25 adapted to be compressed by a pushing portion 26 of the magnification lever 5 for forcing air in the bellows 25 to pass through the flute 24.

With this third embodiment, when the operating lever 19 is rocked by the handle 2 in the direction of the arrow A under an overloaded condition, the pushing portion 26 of the magnification lever 5 moves by a reasonable distance to collapse the bellows 25, so that the air in the bellows is caused to pass through the flute 24 to produce a whistle for warning of the overloading. With this lever hoist of the third embodiment, the overloading can be indicated by means of a simple mechanism without using electrical power.

With the first and third embodiments, a colored portion for indicating an overloading may be provided at the end of the force magnification lever 5 and an opening may be formed in the main lever 1 at a location enabling an operator to see the colored portion through the opening for detecting the overloading. With the second embodiment, the force magnification lever 5 may be adapted to push a bellows for operating a flute for warning an overload or may be adapted to operate a limit switch for actuating a buzzer. In this manner, the overloading can be more easily detected by indicating it both acoustically and visually.

According to the invention when the operating lever 19 is rocked by the gripped handle in the direction for raising and dragging objects under an overloaded condition, the handle is pivotally moved relative to the main lever more than a predetermined angle to operate the overload indicator geared with the rotation of the handle for indicating the overloading, so that the overloaded condition can easily be detected under any working condition.

Figure 9:
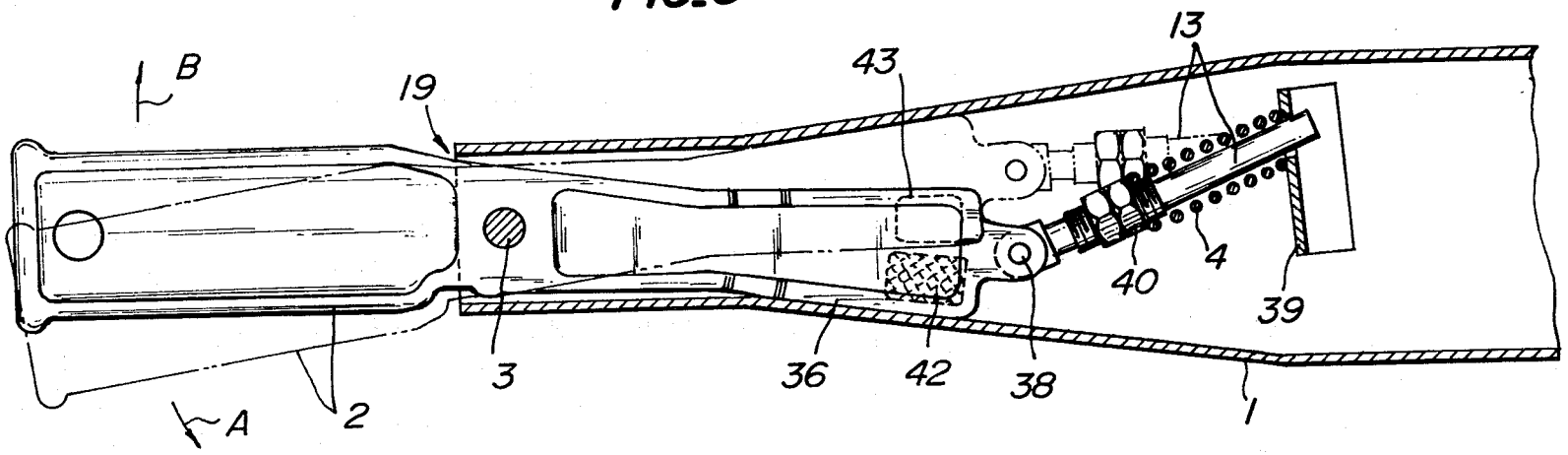
FIG. 9 is a sectional view of a fourth embodiment of the device according to the invention.
Figure 10:
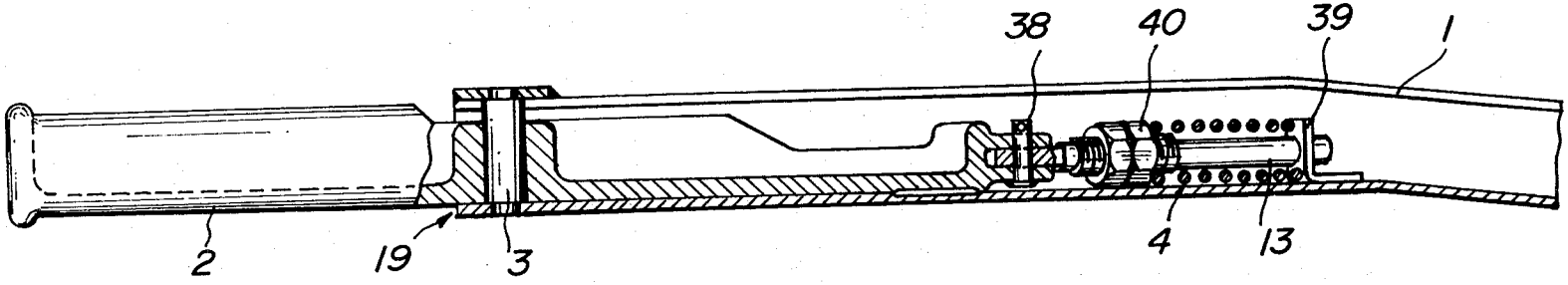
FIG. 10 is a side view of the device shown in FIG. 9.
Figure 11:
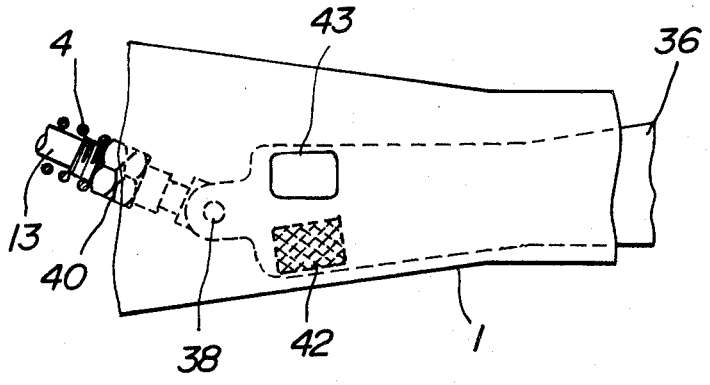
FIG. 11 is a front view of the overload indicator of the fourth embodiment of the invention.

FIGS. 9–11 illustrate a fourth embodiment of the invention, wherein like components have been designated by the same reference numerals in the previous embodiments. To a free end of a main lever 1 is pivotally secured a handle 2 by means of a connecting pin 3 parallel to a support shaft of a change-over ratchet wheel 7. The handle 2 is integrally formed with an arm 36 extending into the main lever 1 and can be rocked relative to the main lever 1 in the directions of arrows A and B to an extent that the side surfaces of an inner end of the arm 36 abuts against the sidewalls of the main lever 1 where the handle 2 assumes respective angular positions relative to the main lever 1 at predetermined angles.

A holding rod 13 is pivotally mounted at its one end on the inner end of the arm 36 by means of a pin 38. The other end of the holding rod 13 is loosely fitted within a support fitting 39 fixed to the main lever 1 so as to be slightly rockable. A holding coil spring 4 is arranged under compression between the support fitting 39 and adjusting nuts 40 threadedly engaged on the holding rod 13 on the side of the pivoted end for the purpose of holding the handle in alignment with the axis of the main lever or in the angular positions relative to the main lever. The arm 36 is provided at the inner end with a colored (for example in red) portion 42 for indicating an overloading, which can be seen by an operator through an opening 43 formed in the wall of the main lever 1. The main lever 1 and the handle 2 form an operating lever 19.

The hoist is operated by repeatedly rocking the operating lever 19 consisting of the main lever 1 and the handle 2 gripped by a hand in the directions of the arrows A and B for raising or dragging objects. In the event that a load exceeds a determined value, when the operating lever 19 is rocked by the handle 2 in the direction of the arrow A for raising or dragging the object, the handle 2 with the arm 36 is rotated or pivotally moved about the connecting pin 3 by an angle proportional to the load in a counterclockwise direction to cause the holding rod 13 pivoted to the arm 36 to be rocked and the coil spring 4 to be compressed.

When the operating lever 19 is rocked by the handle 2 gripped by an operator in the direction of the arrow A under no load or slightly loaded condition, the pin 38 for pivotally connecting the arm 36 and the holding rod 13 has been shifted on one side (in the lower direction as viewed in FIG. 9) of a rectilinear line connecting centers of the connecting pin 3 and the holding rod support hole of the support fitting 39. As the load becomes larger, the center of the pin 38 approaches to the rectilinear line.

In the event of the loading hook 29 attached to the chain or wire rope 28 extending about the load sheave 27 being subjected to an overload, when the operating lever 19 is rotated into the direction of the arrow A, the center of the pin 38 pivotally connecting the arm 36 and the holding rod 13 reaches the rectilinear line connecting centers of the connecting pin 3 and the holding rod support hole of the support fitting 39 or goes across the rectilinear line to a shifted position somewhat beyond the line, so that the handle 2 is held in an angular position relative to the main lever 1 at a predetermined angle as shown in dot-and-dash lines in FIG. 9 by means of the resilience force of the coil spring 4. With this angular position, the overloading can easily be detected by the overload indication colored portion 43 of the main lever 1.

When the handle 2 with the arm 36 is rotated or pivotally moved about the connecting pin 5 from the position shown in solid lines in FIG. 9 in the counterclockwise direction, the increasing rate of the compressive force of the coil spring 4 rapidly reduces owing to a geometrical relation between the positions in solid and dot-and-dash lines of the arm 36 and holding lever 13, as the pin 38 approaches the rectilinear line. Therefore, when the operating lever 19 is rocked under overload condition, the handle 2 rapidly assumes the angular position to indicate the overload condition.

The arm 36 may be constructed so as to actuate a limit switch for operating an overload warning buzzer or to push a bellows for operating a flute for warning an overload condition. In this manner, the overloading can be more easily detected by indicating it both acoustically and visually.

According to the invention when the operating lever has been rocked by the gripped handle in the direction for raising and dragging objects under an overload condition and the handle 2 is in the angular position relative to the main lever 1 to indicate an overload condition, the handle 2 is kept in the angular position by the resilience force of the coil spring 4 to achieve a continuous indication of the overloading which would more improve the safety of the hoist. After a removal of the overload, the handle 2 can easily be returned to the position aligned with the main lever 1 by forcing the handle 2 to rotate about the connecting pin 3 in the opposite direction.

It is understood by those skilled in the art that the foregoing description discloses preferred embodiments of the invention and that various changes and modifications may be made in the invention without departing from the spirit and scope thereof.

What is claimed is:

1. An overload indication device for use in a lever hoist, comprising: a handle having one end pivotably mounted to an operating main lever of a lever hoist at one end thereof, said handle being normally held in alignment with said main lever, and being movable to a position at an angle with respect to said main lever when under an overloaded condition, holding spring means connected between said handle and said main lever, said holding spring means being pivotable between a first position for holding said handle in alignment with said main lever and a second position for maintaining said handle in said angular position, and overload indication means for indicating said overload condition in response to the pivotal movement of said handle.

2. An overload indication device as claimed in claim 1, wherein said handle is integrally formed with an arm extending in said main lever.

3. An overload indication device as defined in claim 2, wherein said overload indication means comprises a colored portion provided on said arm and visible by an operator through an opening formed in said main lever when the handle is pivoted into said angular position.

4. The overload indication device as defined in claim 2, wherein said overload indication means comprises a buzzer with a limit switch and an electric source, and a holding rod is provided adjacent to said arm and said holding spring and movable in response to the pivotal movement of said handle to operate said buzzer for indicating said overload condition.

5. The overload indication device as defined in claim 2, wherein said overload indication means comprises a flute and a bellows to be compressed by a portion of said arm to force air in the bellows to pass through said flute for acoustically indicating said overload condition.

6. An overload indication device as claimed in claim 2, wherein said holding spring means comprises a compression spring coiled about a holding rod, said holding rod having one end pivotally secured to one end of said arm, the other end of said holding rod being secured to said main lever.

7. An overload indication device as claimed in claim 6, further comprising adjusting nuts threadedly engaged on said holding rod for adjusting the compressive force of said spring.

* * * * *